US005427076A

United States Patent [19]

Kobayashi et al.

[11] Patent Number: 5,427,076

[45] Date of Patent: Jun. 27, 1995

[54] EVAPORATIVE FUEL-PROCESSING SYSTEM FOR INTERNAL COMBUSTION ENGINES FOR VEHICLES

[75] Inventors: Makoto Kobayashi; Hajime Uto; Takeshi Suzuki, all of Wako, Japan

[73] Assignee: Honda Giken Kogyo Kabushiki Kaisha, Tokyo, Japan

[21] Appl. No.: 326,957

[22] Filed: Oct. 21, 1994

[30] Foreign Application Priority Data

Oct. 22, 1993 [JP] Japan ..... 5-061864 U

[51] Int. Cl.[6] ..... F02M 33/02

[52] U.S. Cl. ..... 123/520; 123/516; 180/225

[58] Field of Search ..... 123/518, 516, 519, 520, 123/521, 198 D; 180/225, 69.4, 69.5, 296

[56] References Cited

U.S. PATENT DOCUMENTS

| | | | |
|---|---|---|---|
| 3,845,841 | 11/1975 | Kloefkorn | 180/69.4 |
| 4,359,113 | 11/1982 | Latter | 180/69.5 |
| 4,699,232 | 10/1987 | Nebu | 180/225 |
| 5,017,909 | 6/1994 | Yamada | 123/520 |
| 5,060,620 | 10/1991 | Oslapas | 123/516 |
| 5,193,512 | 3/1993 | Steinbrenner | 123/520 |
| 5,224,455 | 7/1993 | Ogasawara | 123/519 |
| 5,245,995 | 9/1993 | Ito | 123/520 |

FOREIGN PATENT DOCUMENTS

| | | | |
|---|---|---|---|
| 0128456 | 8/1983 | Japan | 123/518 |
| 1-125553 | 5/1989 | Japan . | |
| 4132868 | 5/1992 | Japan | 123/519 |
| 5039758 | 2/1993 | Japan | 123/519 |
| 5312113 | 11/1993 | Japan | 123/519 |

*Primary Examiner*—Carl S. Miller

*Attorney, Agent, or Firm*—Nikaido, Marmelstein, Murray & Oram

[57] ABSTRACT

An evaporative fuel-processing system for an internal combustion engine for a vehicle includes an evaporative fuel-guiding port for guiding evaporative fuel generated from the fuel tank, an adsorbent for adsorbing the evaporative fuel guided from the evaporative fuel-guiding port, an evaporative fuel-discharging port for discharging the evaporative fuel desorbed from the adsorbent, and an air-introducing port for introducing air. The system comprises a first passage for allowing the air-introducing port to communicate with the chassis side frame of the vehicle, and a second passage for allowing the air-introducing port to communicate with the engine room of the vehicle. A first one-way valve is arranged across the first passage, for allowing a flow from the chassis side frame of the vehicle to the air-introducing port, and a second one-way valve means is arranged across the second passage, for allowing a flow from the air-introducing port to the engine room of the vehicle.

3 Claims, 6 Drawing Sheets

EVAPORATIVE FUEL-PROCESSING SYSTEM FOR INTERNAL COMBUSTION ENGINES FOR VEHICLES

BACKGROUND OF THE INVENTION

1. Field of the Invention

This invention relates to an evaporative fuel-processing system for internal combustion engines for vehicles, which processes evaporative fuel generated in the fuel tank of the engine mounted in a vehicle.

2. Prior Art

An evaporative fuel-processing system for internal combustion engines for vehicles is conventionally known, for example, from Japanese Provisional Patent Publication (Kokai) No. 1-125553. FIG. 1 schematically shows the whole arrangement of the proposed conventional evaporative fuel-processing system, which comprises a canister a which is formed integrally with check valves b and c, a diaphragm value h, and an evaporative fuel-introducing port e. The check valves b and c are connected to an air cleaner k and the exterior of an engine room via conduits m and n, respectively. When the engine is in stoppage, the check valve c is opened by positive pressure within the canister, and evaporative fuel from a fuel tank f is guided via a charging passage i and the evaporative fuel-guiding port e into the canister a to be adsorbed by an adsorbent g. During traveling of the vehicle in which the engine is installed, the diaphragm value h and the check valve b are opened by negative pressure generated within an intake pipe of the engine, and evaporative fuel which has been collected by the adsorbent g is purged to the engine by hot air blown from the air cleaner k into the canister a via the check valve b. When evaporative fuel is generated in too large an amount to be collected by the canister a, or when pressure within the charging passage i is high, evaporative fuel within the canister a is discharged via the check valve c to the exterior of the engine room l.

However, the above conventional evaporative fuel-processing system has the following inconveniences.

FIG. 2 shows flow characteristics of the check valves. The check valves b and c have valve opening pressure P thereof set within a range of the order of a few mmHg's so as to minimize the intake pressure loss. As is apparent from the figure, the flow rate Q increases sharply with a pressure increase above the valve opening pressure by several mmHg's. FIG. 3 shows fluctuations in pressure within the conduit m caused by pulsations of intake air passing through the air cleaner k. The amplitude of the pressure fluctuations reaches as high as 17 to 20 mmHg when the engine is in a condition where the engine rotational speed is 4000 rpm and load on the engine is high with the throttle valve fully open, provided that the atmospheric pressure assumes a standard value. Thus, the amplitude of pressure fluctuations caused by pulsations of intake air passing through the air cleaner k is much larger than the valve opening pressure P of the check valves b and c, and consequently the check valve b can be made unstable in operation, resulting in leakage of evaporative fuel or air therethrough. Further, the above pressure fluctuations due to pulsations of intake air passing through the air cleaner k causes vibrations of valve seats of the check valves to incur wear thereof, resulting in degraded durability of the check valves.

Besides, if the conduit n is arranged such that its open end, which serves as an air-discharging port, terminates in a hollow portion of a chassis frame of the vehicle outside the engine room l, a smell of gasoline can used as the fuel fill the interior of the vehicle compartment when evaporative fuel is discharged from the canister a.

Next, another arrangement of the system will be considered wherein the check valves b and c as in the arrangement of the system in FIG. 1 are exchanged with each other. FIG. 4 schematically shows the whole arrangement of an evaporative fuel-processing system for internal combustion engines, which is distinguished from the arrangement of the FIG. 1 system only in that the check valves b and c are replaced with each other. With this arrangement, air is introduced from the exterior of the engine room l into the canister a and the air cleaner k serves as an air discharge port. This arrangement can prevent generation of a smell of gasoline from filling the vehicle compartment, which, however, cannot eliminate the inconvenience that the operation of the check valve c can be unstable due to fluctuations in the pressure within the conduit m due to pulsations of intake air passing through the air cleaner k. Rather, during stoppage of the engine, evaporative fuel is stored in the air cleaner k, and an uncontrolled amount of fuel will be drawn into the engine when it again operates, whereby the air-fuel ratio of a mixture supplied to the engine becomes overrich. As a result, further inconveniences, can be incurred such as starting failure of the engine, so-called hesitation, i.e. inability of the engine to increase its rotational speed when the accelerator is stepped on, and engine stalling.

SUMMARY OF THE INVENTION

It is the object of the invention to provide an evaporative fuel-processing system for internal combustion engines for vehicles, which is capable of maintaining stable operation of check valves used therein even when pulsations of intake air passing through the air cleaner occur, as well as preventing generation of a smell of gasoline within the compartment of the vehicle.

To attain the above object, the present invention provides an evaporative fuel-processing system for an internal combustion engine for a vehicle having a chassis side frame and an engine room, the engine having a fuel tank, the system including evaporative fuel-guiding port means for guiding evaporative fuel generated from the fuel tank, adsorbing means for adsorbing the evaporative fuel guided from the evaporative fuel-guiding port means, evaporative fuel-discharging port means for discharging the evaporative fuel desorbed from the adsorbing means, and air-introducing port means for introducing air.

The evaporative fuel-processing system according to the invention is characterized by comprising:

- first passage means for allowing the air-introducing port means to communicate with the chassis side frame of the vehicle;
- second passage means for allowing the air-introducing port means to communicate with the engine room of the vehicle;
- first one-way valve means arranged across the first passage means, for allowing a flow from the chassis side frame of the vehicle to the air-introducing port means; and
- second one-way valve means arranged across the second passage means, for allowing a flow from the air-introducing port means to the engine room of the vehicle.

Preferably, the chassis side frame includes a hollow portion, the first passage means allowing the air-introducing port means to communicate with the hollow portion of the chassis side frame of the vehicle.

Also preferably, the engine room includes a lower portion, the second passage means allowing the air-introducing port means to communicate with the lower portion of the engine room of the vehicle.

The above and other objects, features, and advantages of the invention will be more apparent from the following detailed description taken in conjunction with the accompanying drawings.

DETAILED DESCRIPTION

The invention will now be described in detail with reference to drawings showing an embodiment thereof.

Figure 1:
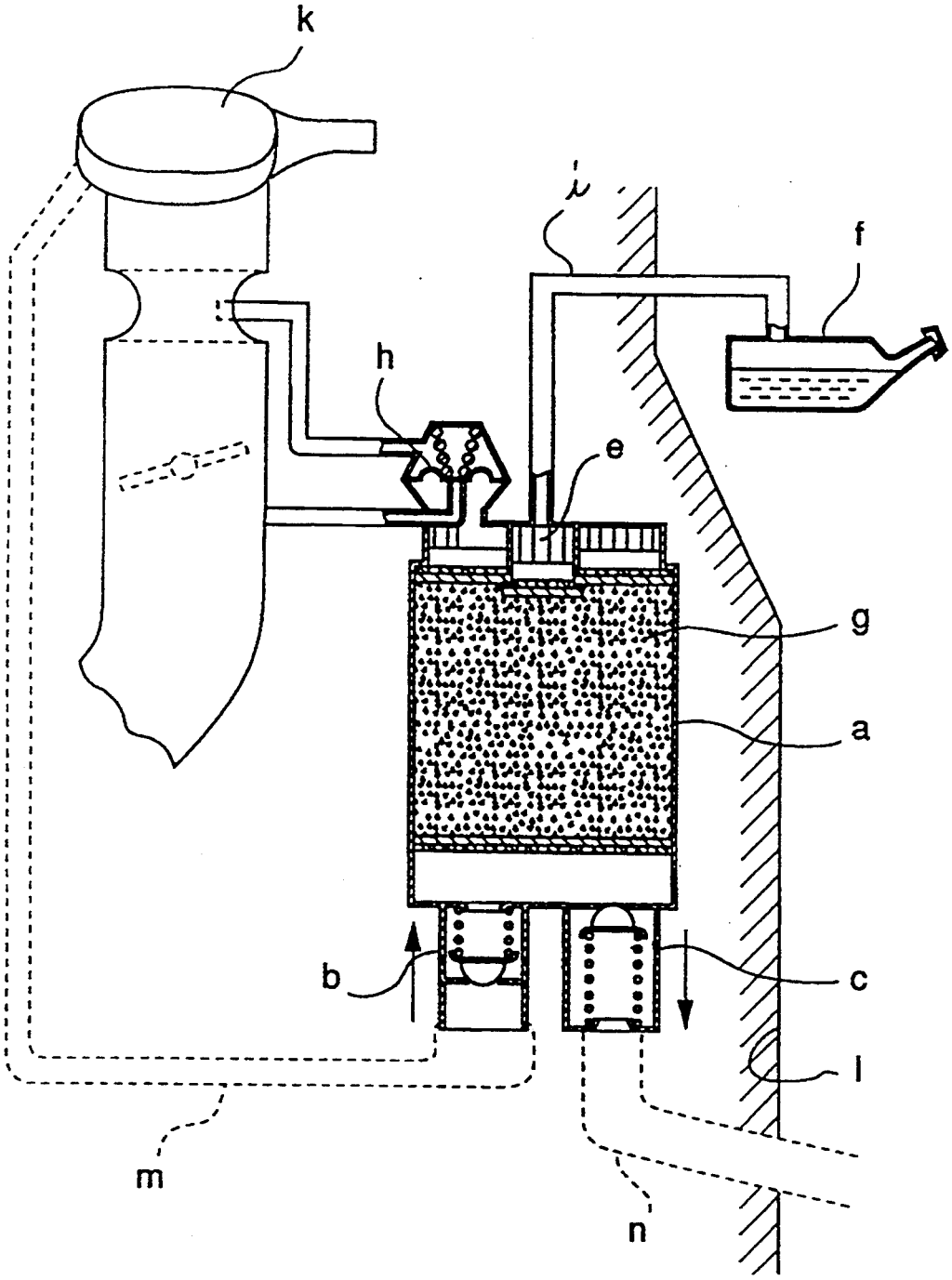
FIG. 1 PRIOR ART
FIG. 1 is a schematic diagram showing an arrangement of a conventional evaporative fuel-processing system for used in an internal combustion engine.
Figure 2:
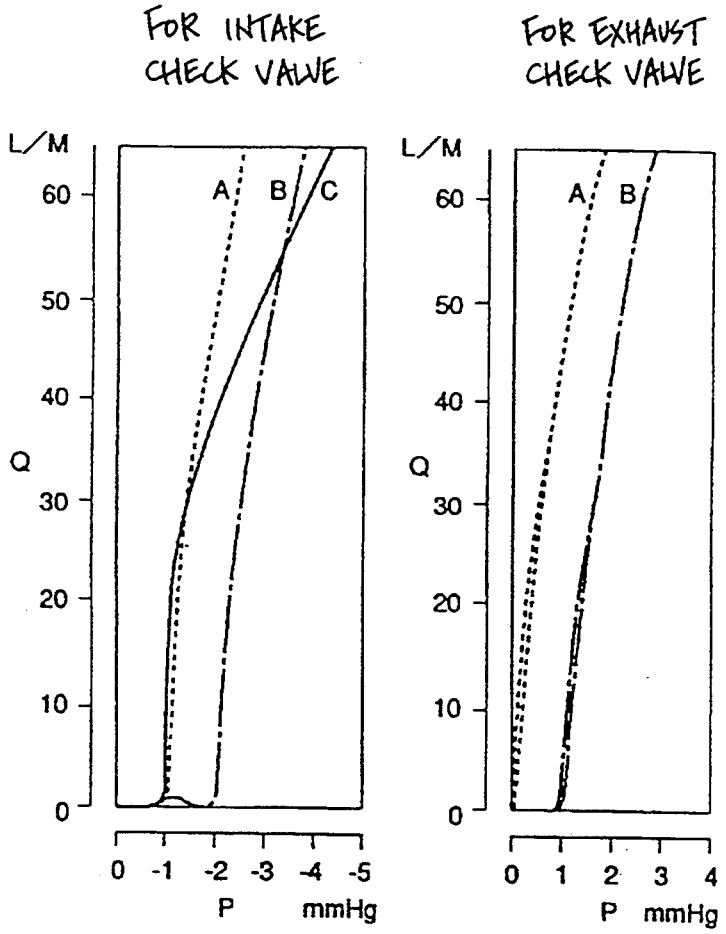
FIG. 2 PRIOR ART
FIG. 2 is a graph showing flow characteristics of check valves used in the conventional evaporative fuel-processing system.
Figure 3:
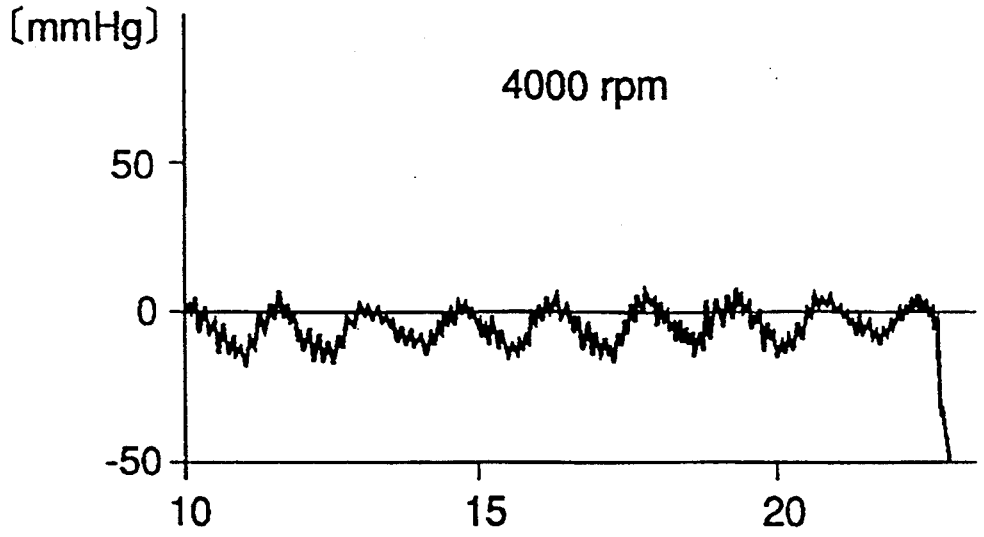
FIG. 3 PRIOR ART
FIG. 3 is a graph showing fluctuations in pressure caused by pulsations of intake air passing through an air cleaner of the engine.
Figure 4:
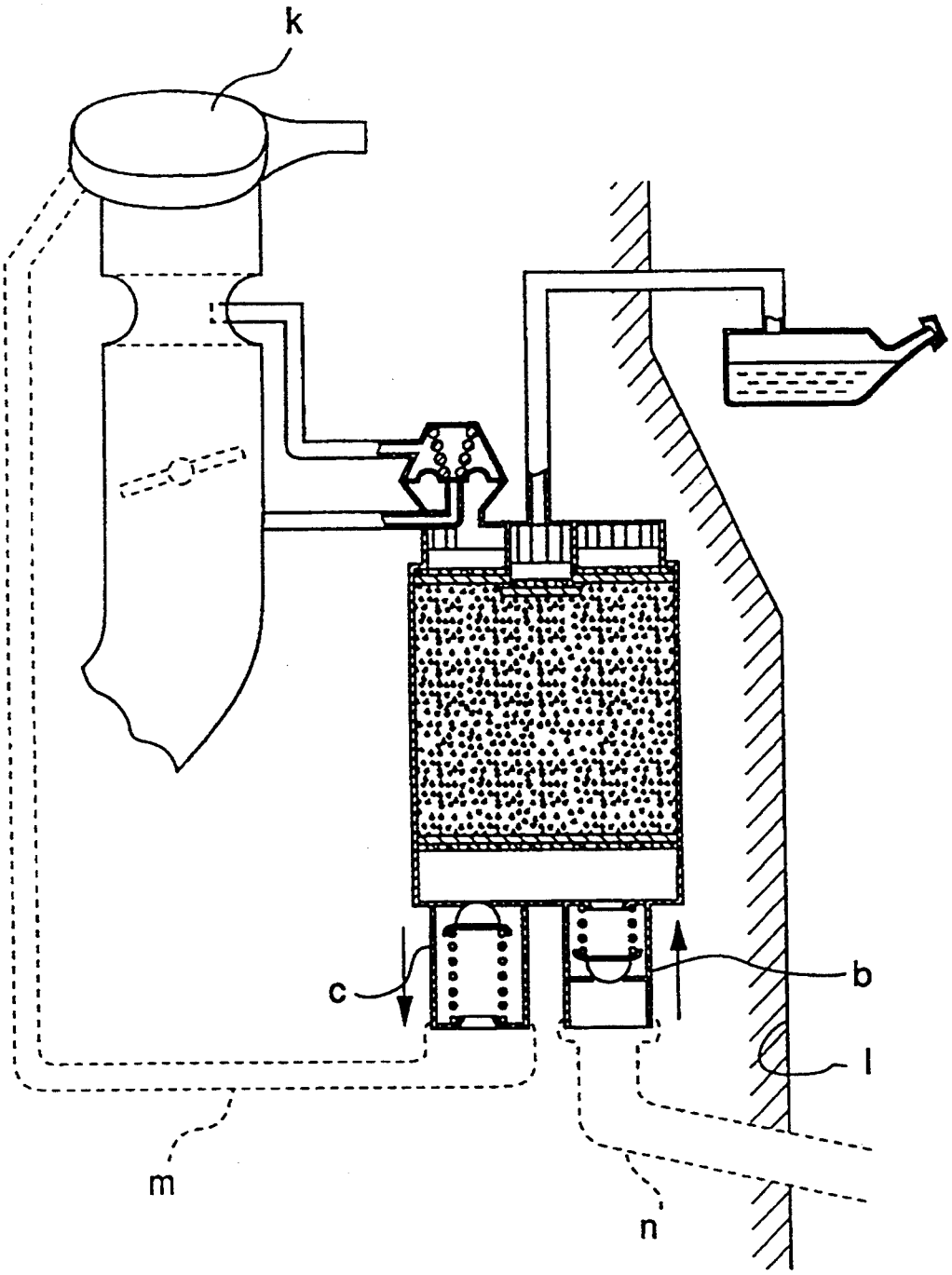
FIG. 4 PRIOR ART
FIG. 4 is a view similar to FIG. 1, showing another arrangement wherein the check valves b and c are exchanged with each other, compared with the arrangement of FIG. 1.
Figure 5:
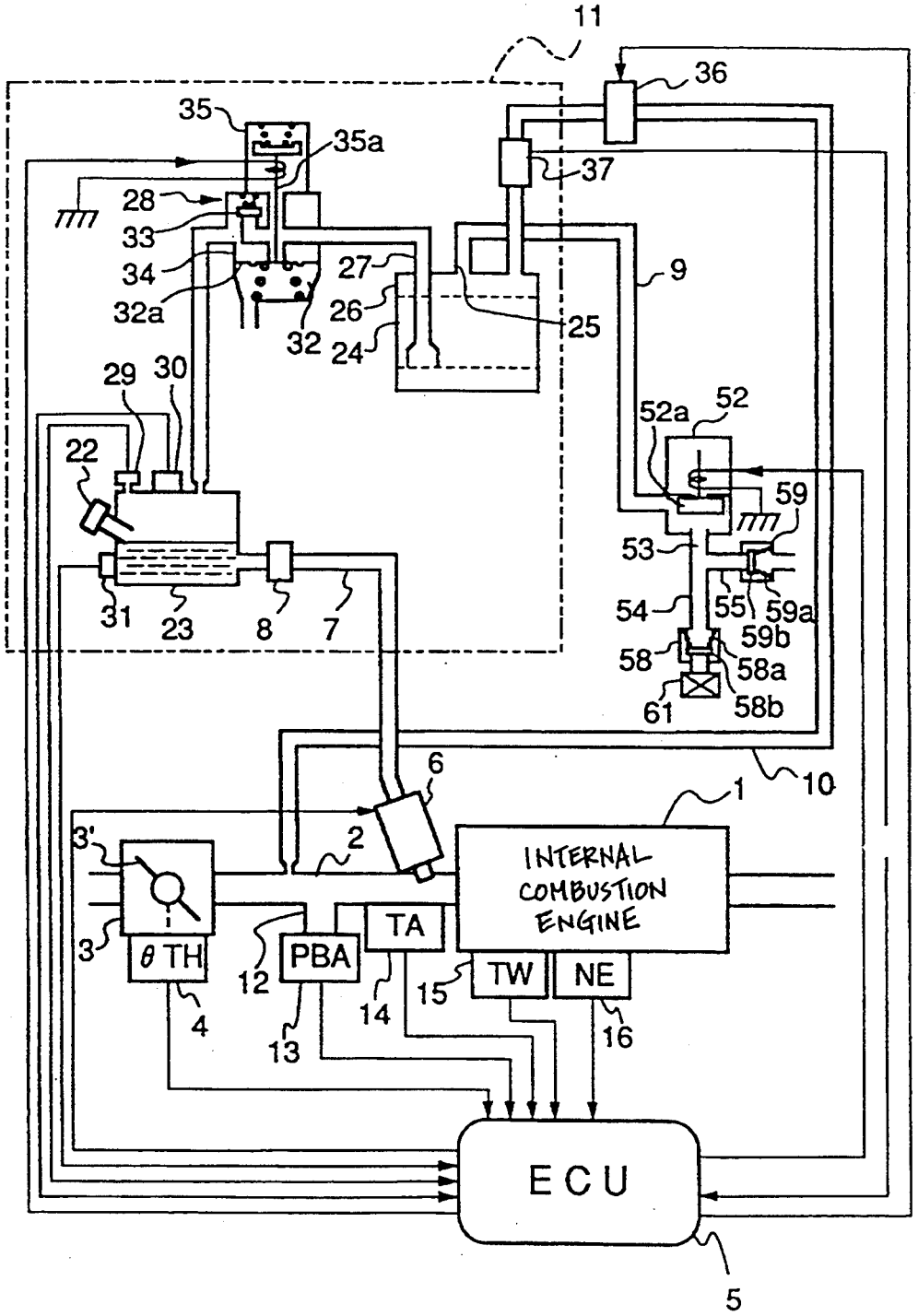
FIG. 5 is a schematic diagram showing the whole arrangement of an air-fuel ratio-processing system for an internal combustion engine for vehicles, according to the present invention.

Referring first to FIG. 5, there is schematically shown the whole arrangement of an internal combustion engine and an evaporative fuel-processing system therefor, according to an embodiment of the invention. In the figure, reference numeral 1 designates an internal combustion engine (hereinafter referred to as "the engine") having e.g. four cylinders, mounted in an automotive vehicle, not shown. In an intake pipe 2 of the engine 1, there is arranged a throttle body 3 accommodating a throttle valve 3' therein, to which is connected a throttle valve opening ($\theta$TH) sensor 4 for sensing the valve opening of the throttle valve 3' and supplying an electric signal indicative of the sensed throttle valve opening to an electronic control unit (hereinafter referred to as "the ECU") 5.

Fuel injection valves 6, only one of which is shown, are each inserted into the interior of the intake pipe 2 at a location intermediate between the cylinder block of the engine 1 and the throttle valve 3' and slightly upstream of an intake valve, not shown. The fuel injection valves 6 are connected to a fuel pump 8 via a fuel supply pipe 7, and electrically connected to the ECU 5 to have their valve opening periods controlled by signals therefrom.

A purging passage 10 opens into the intake pipe 2 at a location downstream of the throttle valve 3', which is connected to an evaporative emission control system 11, referred to hereinafter.

Further, an intake pipe absolute pressure (PBA) sensor 13 is provided in communication with the interior of the intake pipe 2 via a conduit 12 opening into the intake passage 2 at a location downstream of an end of the purging passage 10 opening into the intake pipe 2 for supplying an electric signal indicative of the sensed absolute pressure PBA within the intake pipe 2 to the ECU 5.

An intake air temperature (TA) sensor 14 is inserted into the intake pipe 2 at a location downstream of the conduit 12 for supplying an electric signal indicative of the sensed intake air temperature TA to the ECU 5.

An engine coolant temperature (TW) sensor 15 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The engine rotational speed sensor 16 generates a pulse as a TDC signal pulse at each of predetermined crank angles whenever the crankshaft rotates through 180 degrees, the pulse being supplied to the ECU 5.

The evaporative emission control system 11 is comprised of a fuel tank 23 having a filler cap 22 which is removed for refueling, a canister 26 containing activated carbon 24 as an adsorbent and having an air inlet/outlet port 25 provided in an upper wall thereof, an evaporative fuel-guiding passage (charging passage) 27 connecting between the canister 26 and the fuel tank 23, a two-way valve 28 arranged across the charging passage 27, the purging passage 10 connecting between the canister 26 and the intake pipe 2, and a purge control valve 36 and a hot wire-type flowmeter 37 which are both arranged across the purging passage 10.

The fuel tank 23 is connected to the fuel injection valves 6 via the fuel pump 8 and the fuel supply pipe 7, and has a tank internal pressure (PT) sensor 29 and a fuel amount (FV) sensor 30, both mounted in an upper wall thereof, and a fuel temperature (TF) sensor 31 mounted in a lateral wall thereof. The PT sensor 29, the FV sensor 30, and the TF sensor 31 are electrically connected to the ECU 5. The PT sensor 29 senses pressure (tank internal pressure) PT within the fuel tank 23 and supplies an electric signal indicative of the sensed tank internal pressure PT to the ECU 5. The FV sensor 30 senses a volumetric amount of fuel FV within the fuel tank 23 and supplies an electric signal indicative of the sensed volumetric amount of fuel to the ECU 5. The TF sensor 31 senses the temperature of fuel within the fuel tank 23 and supplies an electric signal indicative of the sensed fuel temperature TF to the ECU 5.

The two-way valve 28 is formed of a positive pressure valve 32 and a negative pressure valve 33. The positive pressure valve 32 has a diaphragm **32*a* to which is connected a rod 35*a* of an electromagnetic driving unit 35. The electromagnetic driving unit 35 is electrically connected to the ECU 5 such that the operation of the two-way valve 28 is controlled by a signal supplied from the ECU 5. More specifically, when the electromagnetic driving unit 35 is energized, the positive pressure valve 32 of the two-way valve 28 is forcedly opened to open the two-way valve 28, whereas when the electromagnetic driving unit 35 is deenergized, the two-way valve 28 is opened only when a difference in pressure between the canister 26 side and the fuel tank 23 side of the valve 28** exceeds a predetermined value.

The purge control valve 36 is arranged across the purging passage 10 extending from the canister 26, which valve has a solenoid, not shown, electrically connected to the ECU 5. The purge control valve 36 is controlled by a signal supplied from the ECU 5 to linearly change the valve opening thereof. That is, the ECU 5 supplies a desired amount of control current to the purge control valve 36 to control the valve opening thereof.

The hot wire-type flowmeter (mass flowmeter) 37 is arranged across the purging passage 10 at a location between the canister 26 and the purge control valve 36. The flowmeter 37 has a platinum wire, not shown, which is heated by an electric current and cooled by a gas flow flowing in the purging passage 10 to have its electrical resistance varied. The flowmeter 37 has an output characteristic variable in dependence on the concentration and flow rate of evaporative fuel flowing in the purging passage 10 as well as on the flow rate of an air-fuel mixture being purged through the purging passage 10. The flowmeter 37 is electrically connected to the ECU 5 to supply the same with an electric signal indicative of the flow rate of the mixture purged through the purging passage 10.

A negative pressure communication passage 9 is connected to the air inlet/outlet port 25 of the canister 26 and communicating with the atmosphere. A vent shut valve 52 is arranged across the passage 9. The vent shut valve 52 is formed of a normally-open type electromagnetic valve which is connected to the ECU 5, which has a valve element **52*a* displaceable by a driving signal from the ECU 5 to connect and disconnect between the passage 9 and a passage 53. When no signal is supplied from the ECU 5, the valve element 52*a* is biased by a spring, not shown, to keep the vent shut valve 52 open. The passage 53 extends from the vent shut valve 52 and is bifurcated into an inlet passage 54 and an outlet passage 55 across which one-way valves 58 and 59 are arranged, respectively. The inlet passage 54 and the outlet passage 55 terminate at respective locations under the atmospheric pressure. The one-way valves 58 and 59 have valve elements 58*b* and 59*b* energize by springs 58*a* and 59*a*, respectively. However, the valve elements 58*b* and 59*b* are disposed to open the respective passages 54 and 55 under opposite pressure conditions to each other. That is, when the pressure within the passage 53 is lower than the atmospheric pressure, the one-way valve 58 is opened, while the pressure within the passage 53 is higher than the atmospheric pressure, the one-way valve 59** is opened.

Details of the constructions and functions of the electromagnetic driving unit 35, the purge control valve 36, and the vent shut valve 52 are described in Japanese Provisional Patent Publication (Kokai) No. 4-349802.

Figure 6:
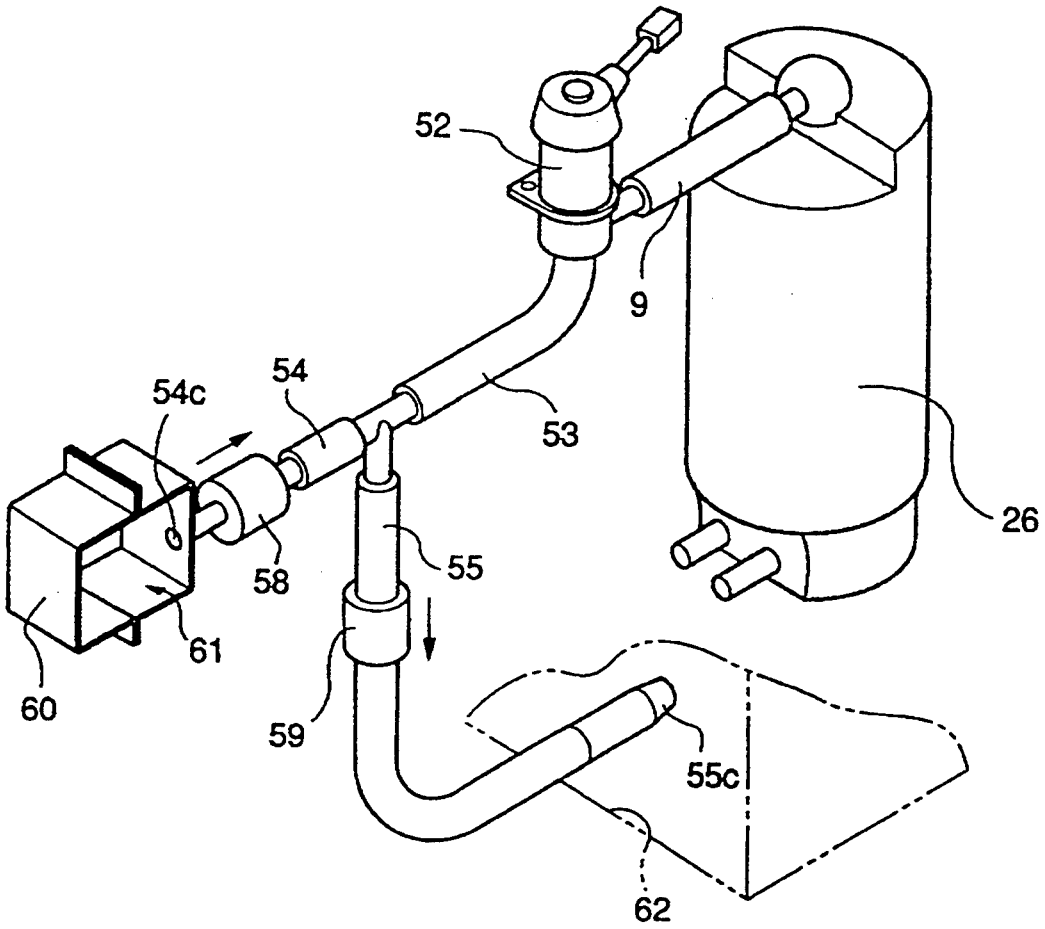
FIG. 6 is a perspective view showing details of an inlet passage and an outlet passage appearing in FIG. 5, and elements associated therewith.

FIG. 6 shows details of the inlet passage 54, the outlet passage 55 and elements associated therewith. An end portion **54*c* of the inlet passage 54 on a side of the one-way valve 58 remote from the vent shut valve 52 is connected to a hollow portion 61 of a side frame 60 of the vehicle chassis in a fashion opening into the interior of the hollow portion 66. An end portion 55*c* of the outlet passage 55 on a side of the one-way valve 59 remote from the vent shut valve 52 is connected to a lower wall portion of an engine room 62 (indicated by the two-dot dash line) in a fashion opening into a lower portion of the engine room 62**.

Next, how air is into and discharged from the evaporative fuel-processing system through the passage arrangement close to the atmosphere, constructed as above will be described hereinbelow:

Evaporative fuel from the fuel tank 23 is normally adsorbed by the canister 26, since the vent shut valve 52 is normally kept open with no supply of the driving signal from the ECU 5. Since the vent shut valve 52 is kept open, the one-way valve 59 is opened by relatively high pressure within the passage 53, and air discharged from the canister 26 through the inlet/outlet port 25 is introduced through the passage 9, the vent shut valve 52, the passage 53, the outlet passage 55 and the one-way valve 59 to be discharged into the lower portion of the engine room 62 through the end portion **55*c* of the outlet passage 55. Therefore, even if evaporative fuel is temporarily supplied from the fuel tank 25, in such a large amount as exceeds the adsorbing capacity of the canister 26, e.g. in summer, part of evaporative fuel which has not been adsorbed by the canister 26 is discharged through the above-mentioned discharge system into the lower portion of the engine room 62**, to thereby avoid generation of a smell of gasoline within the compartment of the vehicle.

To desorb evaporative fuel from the canister 26, the purge control valve 36 is opened by supplying the same with the driving signal from the ECU 5 to purge evaporative fuel from the canister 26, via the purging passage 10 to the engine 1. On this occasion, the vent shut valve 52 is also kept open, and accordingly the pressure within the passage 53 is lowered so that the one-way valve 58 is opened. Then air is drawn from the hollow portion 61 of the chassis side frame 60 through the end portion **54*c* of the inlet passage 54, and introduced through the one-way valve 58, the inlet passage 54, the passage 53, the vent shut valve 52, and the passage 9 into the canister 26. The air drawn from the hollow portion 61 of the chassis side frame 60 is fresh and clean, which does not cause clogging of a filter provided in the canister 26 with dust or trash, nor degrade the sealing performance of the valves. Further, since air is drawn from the hollow portion 61 of the chassis side frame 60, no fluctuation in pressure is generated within the passage 53 by vibration of the air cleaner, leading to stable operation of the one-way valve 58**, to thereby improve the sealing performance thereof.

It goes without saying that the one-way valves 58 and 59 may be replaced by suitable electromagnetic valves to thereby control opening and closing of the inlet passage 54 and outlet passage 55 by a driving signal from the ECU 5.

As described above, the evaporative fuel-processing system according to the present invention is constructed such that the air inlet/outlet port communicates with the chassis side frame via a first passage (inlet passage) and with the engine room via a second passage (outlet passage), and the first and second one-way valves are arranged across the first and second passages, respectively. The first one-way valve allows a flow from the chassis side frame to the air inlet/outlet port, and the second one-way valve allows a flow from the air inlet/outlet port to the engine room. By virtue of the above construction, fresh and clean air can be supplied from the chassis side frame, and air containing evaporative fuel can be discharged into the engine room as an air-discharging port, whereby generation of a smell of gasoline within the compartment of the vehicle can be prevented. Further, no fluctuation in pressure of air occurs even with pulsations of intake air passing through the air cleaner, leading to stable operation of the check valves and improved sealing performance thereof.

What is claimed is:

1. In an evaporative fuel-processing system for an internal combustion engine for a vehicle having a chassis side frame and an engine room, said engine having a fuel tank, said system including evaporative fuel-guiding port means for guiding evaporative fuel generated from said fuel tank, adsorbing means for adsorbing said evaporative fuel guided from said evaporative fuel-guiding port means, evaporative fuel-discharging port means for discharging said evaporative fuel desorbed from said adsorbing means, and air-introducing port means for introducing air into said absorbing means, the improvement comprising:

first passage means for allowing said air-introducing port means to communicate with said chassis side frame of said vehicle;

second passage means for allowing said air-introducing port means to communicate with said engine room of said vehicle;

first one-way valve means arranged across said first passage means, for allowing a flow from said chassis side frame of said vehicle to said air-introducing port means; and second one-way valve means arranged across said second passage means, for allowing a flow from said air-introducing port means to said engine room of said vehicle.

2. An evaporative fuel-processing system as claimed in claim 1, wherein said chassis side frame includes a hollow portion, said first passage means allowing said air-introducing port means to communicate with said hollow portion of said chassis side frame of said vehicle.

3. An evaporative fuel-processing system as claimed in claim 1, wherein said engine room includes a lower portion, said second passage means allowing said air-introducing port means to communicate with said lower portion of said engine room of said vehicle.

* * * * *